US012807297B2

(12) United States Patent
Tagata et al.

(10) Patent No.: US 12,807,297 B2
(45) Date of Patent: Nov. 24, 2026

(54) MARINE PROPULSION SYSTEM, CONTROL METHOD THEREFOR, AND MARINE VESSEL

(71) Applicant: YAMAHA HATSUDOKI KABUSHIKI KAISHA, Iwata (JP)

(72) Inventors: Akihiro Tagata, Shizuoka (JP); Shuichi Moromi, Shizuoka (JP); Koshiro Inaba, Shizuoka (JP); Teppei Morishita, Shizuoka (JP); Kazumichi Yoshida, Shizuoka (JP); Katsutoshi Naito, Shizuoka (JP); Yuta Kubota, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 123 days.

(21) Appl. No.: 18/783,753

(22) Filed: Jul. 25, 2024

(65) Prior Publication Data

US 2025/0050997 A1 Feb. 13, 2025

(30) Foreign Application Priority Data

Aug. 10, 2023 (JP) ..... 2023-130810

(51) Int. Cl.
*B63H 25/42* (2006.01)
*B63H 5/08* (2006.01)
(Continued)

(52) U.S. Cl.
CPC ..... *B63H 25/42* (2013.01); *B63H 5/08* (2013.01); *B63H 5/125* (2013.01); *B63H 2021/216* (2013.01)

(58) Field of Classification Search
CPC ..... B63H 25/42; B63H 5/08; B63H 5/125; B63H 2021/216; B63H 20/10;
(Continued)

(56) References Cited

U.S. PATENT DOCUMENTS 8,190,316 B2 * 5/2012 Kaji ..... B63H 21/213 318/588
2005/0092225 A1 * 5/2005 Kaji ..... B63H 25/42 114/144 R
(Continued)

FOREIGN PATENT DOCUMENTS

JP H07165189 A 6/1995
JP 2000302098 A 10/2000
(Continued)

OTHER PUBLICATIONS

Official Communication issued in corresponding European Patent Application No. 24192407.5, mailed on Feb. 6, 2025, 11 pages.

*Primary Examiner* — Abby J Flynn
*Assistant Examiner* — Matthew John Moscola
(74) *Attorney, Agent, or Firm* — Keating & Bennett, LLP

(57) ABSTRACT

In a marine propulsion system, a controller determines a point of action of a resultant force of first propulsion devices at a stern of a hull during a parallel motion based on a target direction and a required propulsion force, controls the first propulsion devices to apply the resultant force in the target direction to the point of action, and controls a second propulsion device in front of the stern to apply a propulsion force to cancel undesired components of the resultant propulsion force. The controller moves the point of action backward as the required propulsion force increases during the parallel motion, and increases the propulsion force of one first propulsion device in a forward direction when the point of action reaches a rear limit position and the propulsion force of another first propulsion device in a backward direction reaches an upper limit propulsion force.

11 Claims, 11 Drawing Sheets

(51) Int. Cl.
*B63H 5/125* (2006.01)
*B63H 21/21* (2006.01)

(58) Field of Classification Search
CPC .. B63H 25/02; B63H 2025/026; B63H 20/12; B63H 21/21; B63B 79/40
See application file for complete search history.

(56) References Cited

U.S. PATENT DOCUMENTS

| | | | | |
|---|---|---|---|---|
| 2015/0166159 | A1* | 6/2015 | Inoue | B63H 20/12 440/53 |
| 2016/0114875 | A1* | 4/2016 | Wong | B63H 20/12 440/55 |
| 2017/0305520 | A1* | 10/2017 | Watanabe | B63H 25/42 |
| 2020/0331578 | A1 | 10/2020 | Sakashita et al. | |

FOREIGN PATENT DOCUMENTS

| | | | |
|---|---|---|---|
| JP | 5151157 | B2 | 2/2013 |
| JP | 2020168921 | A | 10/2020 |

* cited by examiner

MARINE PROPULSION SYSTEM, CONTROL METHOD THEREFOR, AND MARINE VESSEL

CROSS REFERENCE TO RELATED APPLICATIONS

This application claims the benefit of priority to Japanese Patent Application No. 2023-130810 filed on Aug. 10, 2023. The entire contents of this application are hereby incorporated herein by reference.

BACKGROUND OF THE INVENTION

1. Field of the Invention

The present invention relates to marine propulsion systems, control methods therefor, and marine vessels.

2. Description of the Related Art

Conventionally, there is a known marine propulsion system including a propulsion device arranged in front of a stern, separately from a propulsion device, such as an outboard motor, arranged at the stern.

For example, a marine vessel disclosed in Japanese Patent Laid-Open Publication No. 2020-168921 includes two propulsion devices (outboard motors) at a stern and a bow thruster at a bow, and enables parallel motions, such as a lateral motion. For example, during a lateral motion, one of the two outboard motors applies a propulsion force including a component in a backward direction to a hull, and the other applies a propulsion force including a component in a forward direction to the hull so that a resultant force of the propulsion forces acts on a point of action behind a center of gravity of the marine vessel. The bow thruster reduces or promotes veering of the marine vessel.

However, there is a practical upper limit to the propulsion force that can be generated by the propulsion device at the stern. For example, when a propulsion device generates a propulsion force including a component in the backward direction, in particular, it is necessary to reduce a rotation speed within a range in which cavitation does not occur. In the meantime, the bow thruster does not have a steering function, and thus cannot generate a component in a front-back direction.

Therefore, during the lateral motion, it is necessary to control the two propulsion devices so that the resultant force will not include a component in the front-back direction. As a result, the maximum output of the propulsion device that provides the propulsion force including the component in the forward direction is restricted by the maximum output of the propulsion device that provides the propulsion force including the component in the backward direction.

In this way, since the propulsion force in the lateral direction is limited to be within a certain range, the performance of the lateral motion is restricted. This applies to not only the case of moving to just to the side, but also to the case of a parallel motion moving obliquely without turning.

SUMMARY OF THE INVENTION

Example embodiments of the present invention provide marine propulsion systems that each enhances the performance of a parallel motion of a marine vessel.

According to an example embodiment of the present invention, a marine propulsion system includes first propulsion devices that are steerable and located at a stern of a hull, a second propulsion device that is steerable and located at a predetermined position in front of the stern of the hull, and a controller configured or programmed to obtain a target direction and required propulsion force when an instruction of a parallel motion is obtained or when it is determined to execute the parallel motion, determine a point of action of a resultant force of propulsion forces applied to the hull by the first propulsion devices during execution of the parallel motion based on the target direction and the required propulsion force, control the first propulsion devices to apply the resultant force corresponding to the required propulsion force in the target direction to the point of action, and control the second propulsion device to apply a propulsion force to the predetermined position to cancel a veering component and a component in a direction perpendicular to the target direction with respect to the hull due to the resultant force. The controller is configured or programmed to move the position of the point of action backward or increase the propulsion forces of the first propulsion devices as the required propulsion force increases during the execution of the parallel motion. The controller is configured or programmed to increases the propulsion force of at least one of the first propulsion devices applying the propulsion force including a component in a forward direction as the required propulsion force increases when the position of the point of action reaches a rear limit position and the propulsion force of at least one of the first propulsion devices applying the propulsion force including a component in a backward direction reaches an upper limit propulsion force during the execution of the parallel motion.

According to another example embodiment of the present invention, a marine vessel includes a hull, and the marine propulsion system of the above example embodiment.

According to another example embodiment of the present invention, a control method for a marine propulsion system including first propulsion devices that are steerable and located at a stern of a hull and a second propulsion device that is steerable and located at a predetermined position in front of the stern of the hull, includes obtaining a target direction and a required propulsion force when an instruction of a parallel motion is obtained or when it is determined to execute the parallel motion, determining a point of action of a resultant force of propulsion forces applied to the hull by the first propulsion devices during execution of the parallel motion based on the target direction and the required propulsion force, controlling the first propulsion devices to apply the resultant force corresponding to the required propulsion force in the target direction to the point of action, controlling the second propulsion device to apply a propulsion force to the predetermined position to cancel a veering component and a component in a direction perpendicular to the target direction with respect to the hull due to the resultant force, moving the position of the point of action backward or increasing the propulsion forces of the first propulsion devices as the required propulsion force increases during the execution of the parallel motion, and increasing the propulsion force of at least one of the first propulsion devices applying the propulsion force including a component in a forward direction as the required propulsion force increases when the position of the point of action reaches a rear limit position and the propulsion force of at least one of the first propulsion devices applying the propulsion force including a component in a backward direction reaches an upper limit propulsion force that is generatable during the execution of the parallel motion.

According to the above example embodiments, the performance of parallel motion of marine vessels is enhanced.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Hereinafter, example embodiments of the present invention will be described with reference to the drawings.

Figure 1:
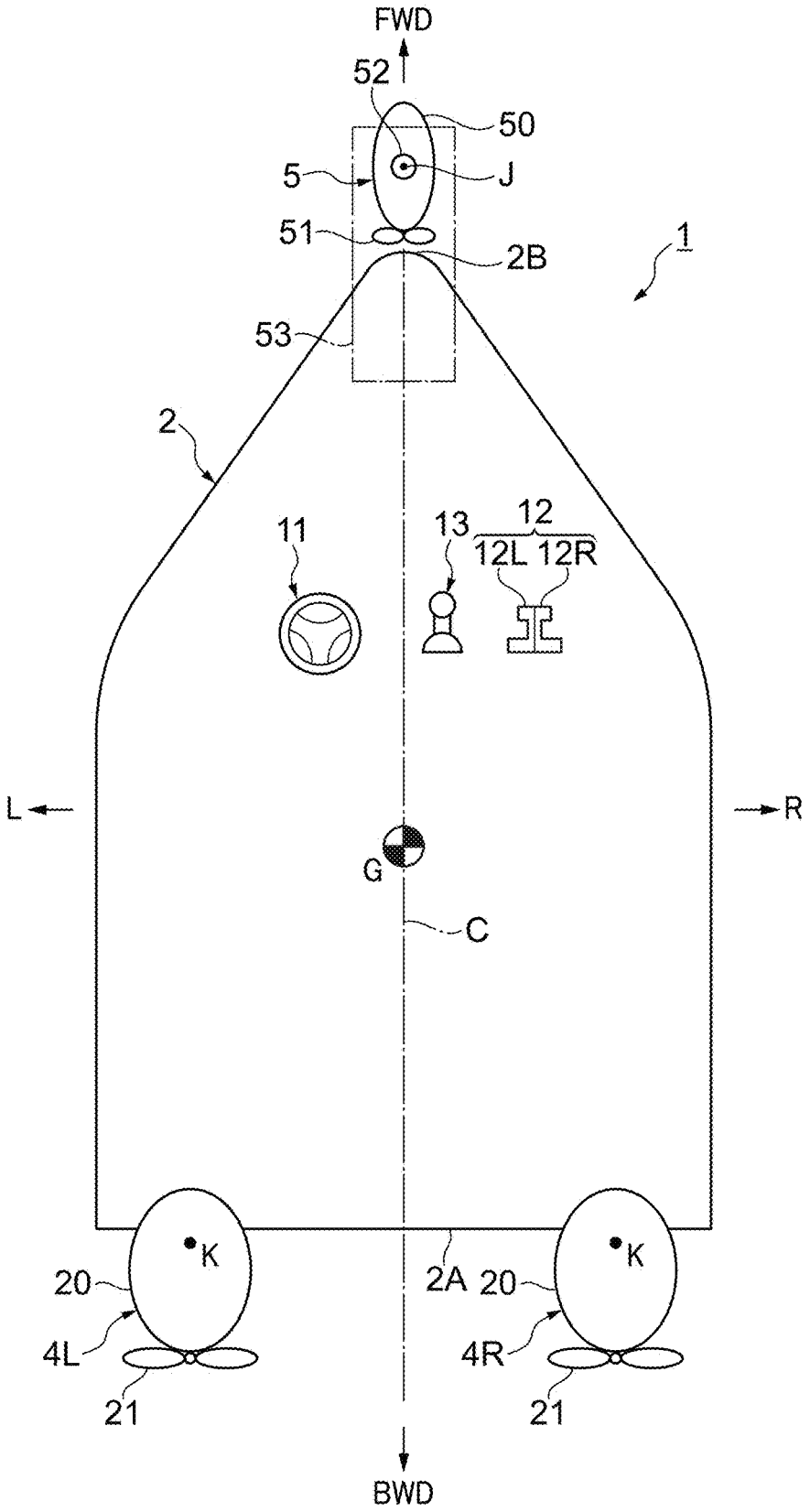
FIG. 1 is a schematic top view showing a marine vessel to which a marine propulsion system is provided.

FIG. 1 is a schematic top view of a marine vessel to which a marine propulsion system according to an example embodiment of the present invention is provided. The marine vessel 1 includes a hull 2.

In the drawings, a forward direction (bow direction) of the marine vessel 1 is indicated by an arrow FWD, and a backward direction (stern direction) is indicated by an arrow BWD. Further, a starboard direction of the marine vessel 1 is indicated by an arrow R, and a port direction thereof is indicated by an arrow L.

A center line C of the hull 2 passes through a center of a stern 2A and a tip of a bow 2B. The center line C passes through a center of gravity G (veering center) of the marine vessel 1. A front-back direction is a direction parallel to the center line C. A front is in a direction upward along the center line C shown in FIG. 1 (a direction toward the bow 2B viewed from the stern 2A). A back is in a direction downward along the center line C shown in FIG. 1. The left-right direction is based on a case where the hull 2 is viewed from the back. An up-down direction is perpendicular to the front-back direction and the left-right direction.

The marine vessel 1 includes steerable outboard motors 4L and 4R (first propulsion devices) and a steerable trolling motor 5 (a second propulsion device) as propulsion devices that propel the hull 2. The outboard motors 4L and 4R are steerably disposed at the stern 2A, and the trolling motor 5 is steerably disposed at the bow 2B. The trolling motor 5 may be disposed at a predetermined position in front of the stern 2A of the hull 2, and the position of the trolling motor 5 is not limited to the bow 2B of the hull 2. The outboard motors 4L and 4R and the trolling motor 5 may be a main propulsion device and an auxiliary propulsion device, respectively, of the marine vessel 1.

The outboard motors 4L and 4R are attached to the stern 2A at positions bilaterally symmetrical with respect to the center line C. The outboard motor 4L is attached to the port side aft section and the outboard motor 4R is attached to the starboard side aft section.

The marine vessel 1 is provided with a steering (e.g., steering wheel) 11 operated mainly for steering, a remote control unit 12 operated mainly for output adjustment of the outboard motors 4L and 4R, and a joystick 13 operated mainly for steering and output adjustment of the outboard motors 4L and 4R. The remote control unit 12 includes two throttle levers 12L and 12R, and is operated to adjust the outputs of the engines of the outboard motors 4L and 4R and to switch between forward and backward. Each throttle lever is operable in the forward direction and the backward direction from a zero operation position. The layout of these components is not limited to the illustrated one.

Figure 2:
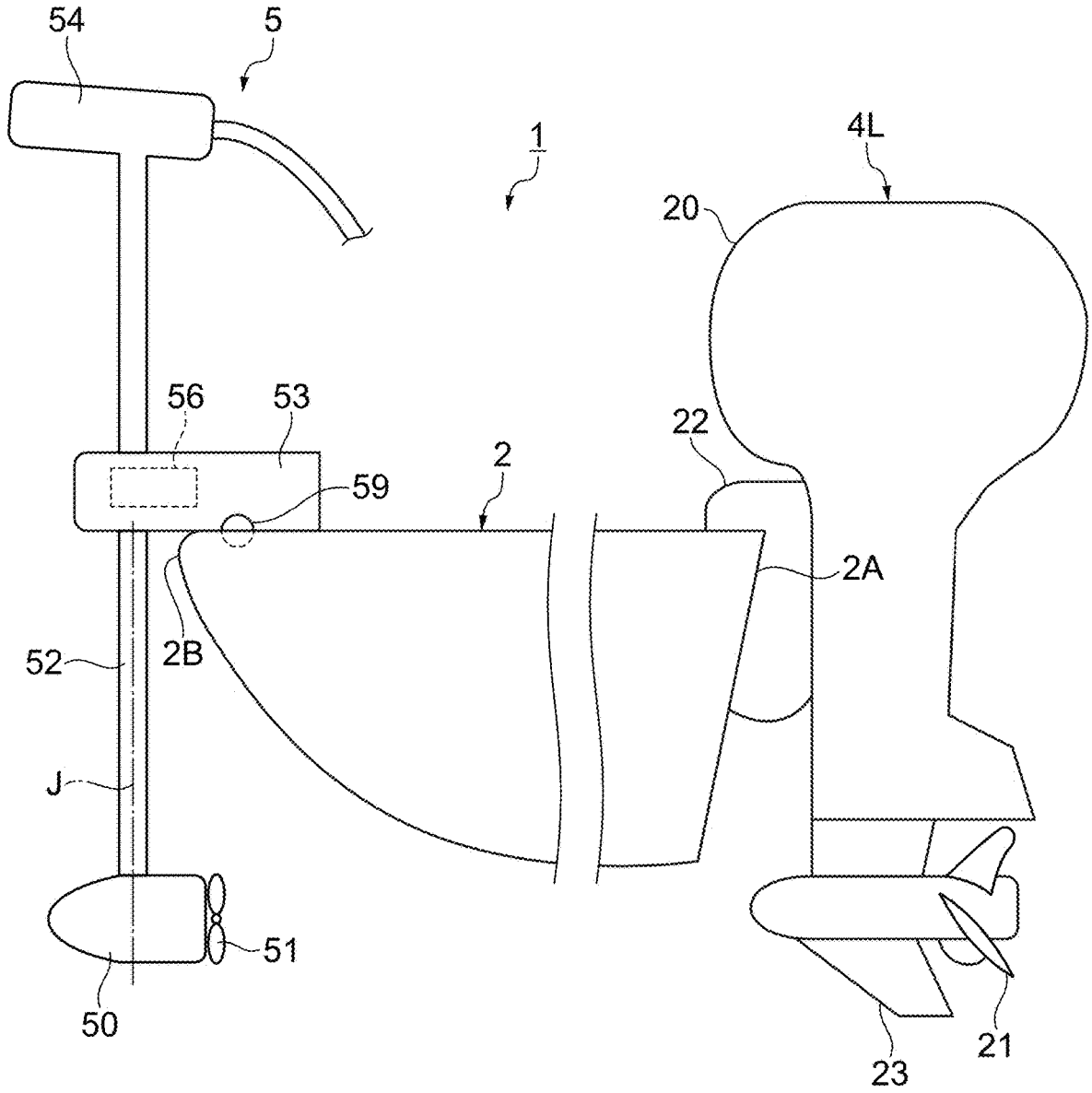
FIG. 2 is a schematic side view showing bow and stern portions of the marine vessel.

FIG. 2 is a schematic side view showing the bow portion and the stern portion of the marine vessel 1.

Each of the outboard motors 4L and 4R includes an outboard motor body 20 (FIG. 1). A propeller 21 and a skeg (rudder) 23 are disposed in a lower portion of the outboard motor body 20. Since the configurations of the outboard motors 4L and 4R are common to each other, a detailed configuration of the outboard motor 4L will be described as a representative. The outboard motor body 20 is mounted to the stern 2A with a mounting mechanism 22. The mounting mechanism 22 includes a clamp bracket detachably fixed to the stern 2A and a swivel bracket coupled to the clamp bracket so as to be rotatable about a tilt shaft. The outboard motor body 20 is mounted to the swivel bracket so as to be rotatable about a steering axis center K (FIG. 1). The steering angle of the outboard motor 4L is changed by rotating the outboard motor body 20 about the turning axis center K.

The trolling motor 5 is an aftermarket device that can be externally attached to the already completed marine vessel 1 at a later time, unlike a bow thruster (not shown). The trolling motor 5 is able to apply a propulsion force to the hull 2 in any direction around a rotation axis J (FIG. 1), which is the center line of a rotation shaft 52.

The trolling motor 5 is electrically driven. The trolling motor 5 includes an electric motor 50 and a propeller 51 that is rotationally driven by the electric motor 50 to generate a propulsion force. The trolling motor 5 further includes the rotation shaft 52 extending upward from the electric motor 50 through the rotation axis J, and a bracket 53 fixed to the bow 2B and supporting the rotation shaft 52 rotatably around the rotation axis J. The electric motor 50 rotates around the rotation axis J integrally with the rotation shaft 52.

An upper portion of the rotation shaft 52 protrudes upward from the bracket 53. An operation panel 54 including an indicator (not shown) indicating the direction of the propeller 51 in the water is provided at the upper end of the rotation shaft 52. The bracket 53 is provided with an operation unit (not shown), such as a foot pedal, for a user to directly operate the trolling motor 5. In addition, a wireless remote controller (not shown) for the user to operate the trolling motor 5 may be provided. The operation panel 54 is not shown in FIG. 1.

The trolling motor 5 includes, for example, an electric steering unit 56 in the bracket 53 and rotates the rotation shaft 52 and the electric motor 50 around the rotation axis J, and an ECU (not shown) in the operation panel 54 and controls the electric motor 50 and the steering unit 56.

The steering unit 56 includes, for example, a servo motor. The trolling motor 5 is able to change its direction by a steering operation by the steering unit 56. First, the steering unit 56 changes the direction of the propulsion force generated by the rotating propeller 51 by rotating the electric motor 50 about the rotation axis J to change the direction of the electric motor 50 within a range of 360 degrees or more. This changes the steering angle of the trolling motor 5, and the direction of the propulsion force applied to the hull 2 by the trolling motor 5 changes.

The bracket 53 is vertically pivotable with respect to the hull 2 around a pivot shaft 59. The bracket 53 is rotated about the pivot shaft 59 so that the trolling motor 5 can be moved between a use position and a storage position. FIGS. 1 and 2 show a state in which the trolling motor 5 is in the use position. When the trolling motor 5 is in the use position, the electric motor 50 and the propeller 51 are located below a waterline (not shown).

In the present example embodiment, the plurality of maneuvering modes are roughly classified into an outboard motor mode in which the trolling motor 5 is not used and cooperation modes in which the trolling motor 5 and the outboard motors 4L and 4R are used in combination. The outboard motor mode is a maneuvering mode in which the outboard motors 4L and 4R are controlled mainly according to the rotation operation of the steering 11 and the operation of the remote control unit operator 12.

The cooperation modes include automatic maneuvering modes, a joystick mode, and a drive mode. The joystick mode is a maneuvering mode in which the outboard motors 4L and 4R and the trolling motor 5 are controlled according to the operation of the joystick 13. The drive mode is a maneuvering mode in which the outboard motors 4L and 4R and the trolling motor 5 are controlled based on operations of various switches and paddles (described below) in the steering 11 and a rotation operation of the steering 11.

The automatic maneuvering modes are modes in which the outboard motors 4L and 4R and the trolling motor 5 are controlled to automatically hold a route, a heading, or a position of the hull 2, when a target position of the hull 2 or a target heading of the hull 2 is designated. Typical examples of the automatic maneuvering modes include a Stay Point™, a Fish Point™, and a Drift Point™.

Figure 3:
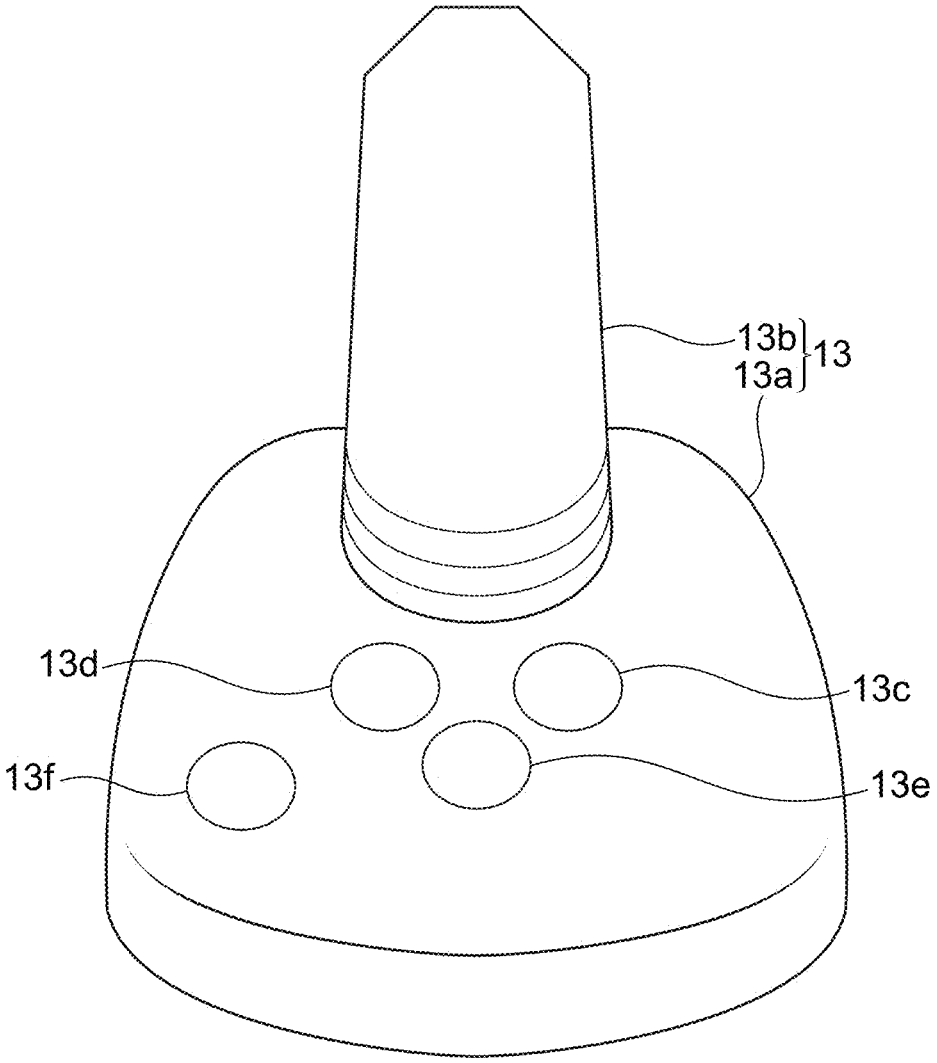
FIG. 3 is a perspective view showing a joystick.

FIG. 3 is a perspective view showing the joystick 13. The joystick 13 includes a main body 13*a* and a columnar stick 13*b* extending upward from the main body 13*a*.

A stay point button 13*c*, a fish point button 13*d*, a drift button 13*e*, and a joystick button 13*f* are arranged on the main body 13*a*. The stay point button 13*c* receives an operation of switching ON and OFF of the Stay Point™. The fish point button 13*d* receives an operation of switching ON and OFF of the Fish Point™. The drift button 13*e* receives an operation of switching ON and OFF of the Drift Point™. The joystick button 13*f* receives an operation of switching ON and OFF of the joystick mode.

The Stay Point™ is one of the automatic maneuvering modes in which the heading of the bow 2B of the hull 2 is maintained at a set target heading and the position of the hull 2 is maintained at a set target point. The Fish Point™ is one of the automatic maneuvering modes in which the hull 2 is directed to a set target point by turning the hull 2 and the moving direction of the hull 2 is maintained toward the target point. The Drift Point™ is one of the automatic maneuvering modes in which the hull 2 is moved by receiving an external force including wind and current while maintaining the heading at the bow 2B of the hull 2 in the target heading by turning the hull 2. It is not essential that all of the above-mentioned buttons are mounted on the main body 13*a*.

Figure 4:
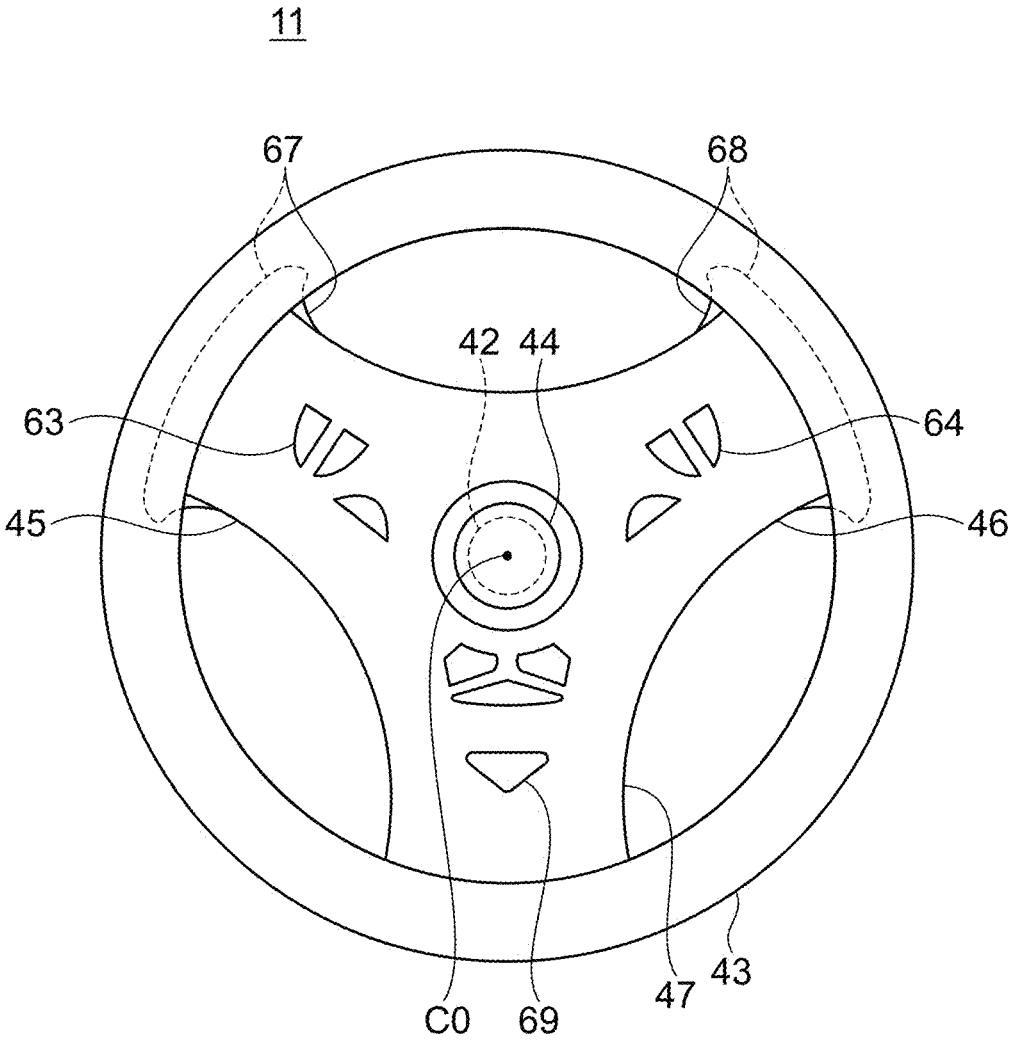
FIG. 4 is a view showing a steering wheel viewed approximately from a front.

FIG. 4 is a view showing the steering 11 viewed approximately from the front. The steering 11 includes a central portion 44, an annular wheel 43, and three spokes (a first spoke 45, a second spoke 46, and a third spoke 47). The steering 11 is supported by the hull 2 so as to be rotatable about a rotation fulcrum C0.

The steering 11 includes a plurality of switches. For example, a changeover switch 69, a left switch 63, and a right switch 64 are disposed on the surface of the steering 11. The steering 11 includes a left paddle 67 and a right paddle 68. The left paddle 67 and the right paddle 68 are pivotable in the front-back direction. The left paddle 67 and the right paddle 68 are operators to generate an instruction to provide the propulsion force to the hull 2 in the backward direction and the forward direction, respectively.

A controller 70 changes the magnitude of the propulsion force in the backward direction according to a throttle opening angle of the left paddle 67 when the left paddle 68 is operated. The controller 70 changes the magnitude of the propulsion force in the forward direction according to a throttle opening angle of the right paddle 68 when the right paddle 68 is operated. Mainly in the drive mode, the controller 70 controls the trolling motor 5 and the outboard motors 4L and 4R according to the operation signals of the switches 63 and 64 and the paddles 67 and 68.

The joystick mode and the drive mode enable on-the-spot turning in addition to parallel motions including a lateral motion.

The parallel motion means that the hull 2 moves in the horizontal direction without turning in a yaw direction about the center of gravity G (FIG. 1). For example, the lateral motion moves the hull 2 to the left or right without turning. Addition of the propulsion force in the front-back direction during the lateral motion enables the parallel motion of the hull 2 in an oblique direction (obliquely left, right, front, and back). The on-the-spot turning rotates the hull 2 in the yaw direction around the center of gravity G. The parallel motion and the turning may be applied in combination.

About the motions, for example, when the parallel motion is performed in the joystick mode, the hull 2 moves parallel to a direction in which the stick 13*b* is turned. When the parallel motion is performed in the drive mode, the operations of the left switch 63 and the right switch 64 achieve leftward lateral motion and rightward lateral motion of the hull 2, respectively. When the paddles 67 and 68 are operated, the hull 2 moves backward and forward, respectively. When one of the paddles 67 and 68 is operated in parallel with the operation of the left switch 63 or the right switch 64, the hull 2 moves in parallel to an oblique direction because the forward or backward motion is added to the lateral motion.

The stick 13*b* can be operated to twist (or rotate) around the axial center of the stick 13*b*. In the joystick mode, an instruction to turn (or veer) can be provided by twisting the stick 13*b*. In the drive mode, an instruction to turn (or veer) can be provided by a rotation operation of the wheel 43.

Energizing elements (not shown) are provided about the tilting direction and the twisting direction of the stick 13*b* of the joystick 13, and the stick 13*b* is always biased to a neutral position. Therefore, when the user releases the stick 13*b*, the stick 13*b* automatically returns to the neutral position.

Figure 5:
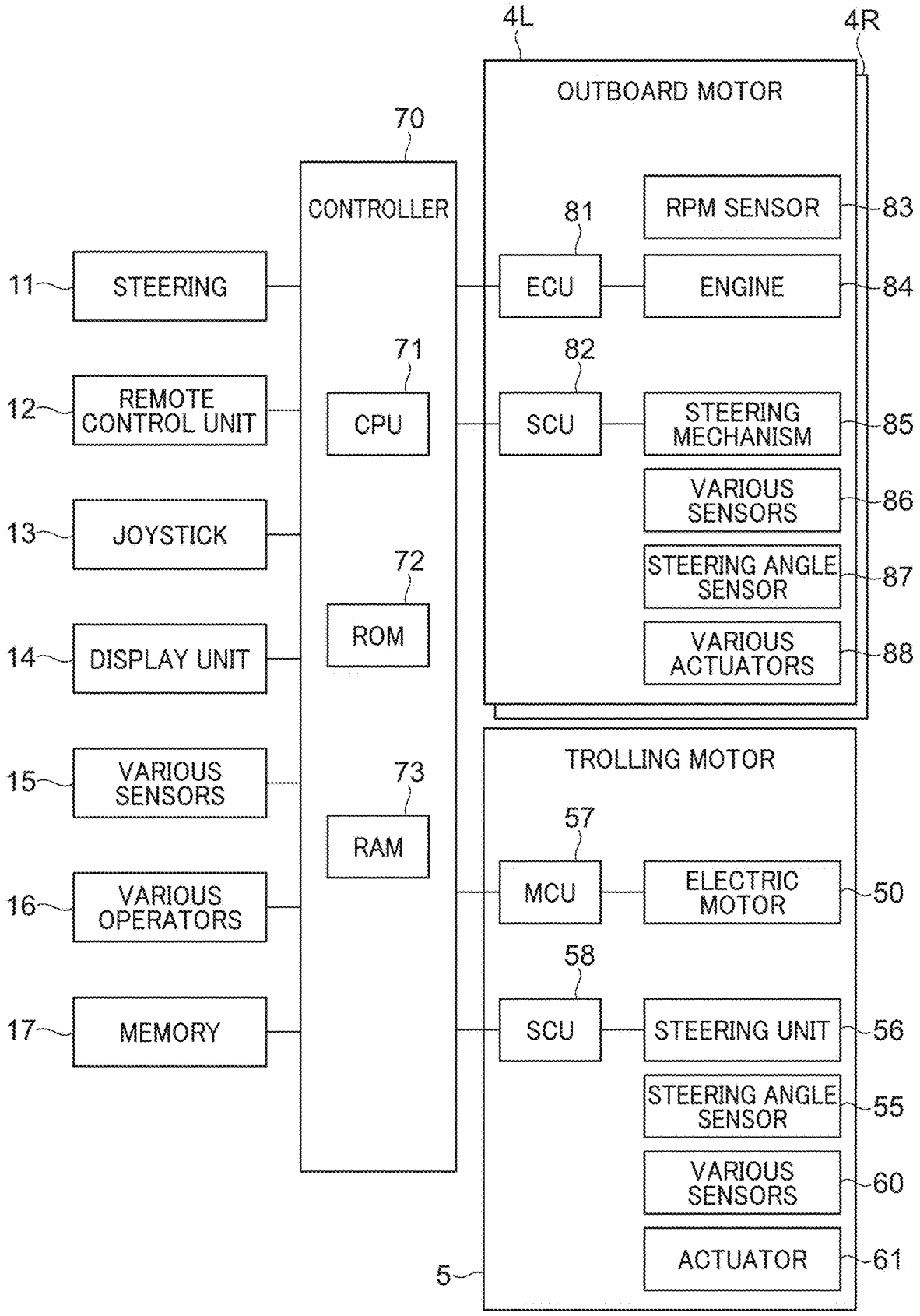
FIG. 5 is a block diagram showing a marine propulsion system.

FIG. 5 is a block diagram showing the marine propulsion system. The marine propulsion system includes a display unit 14, various sensors 15, the various operators 16, and a memory 17 in addition to the controller 70, the outboard motors 4L and 4R, the trolling motor 5, the steering 11, the remote control unit 12, and the joystick 13.

The controller 70 includes a CPU 71, a ROM 72, a RAM 73, and a timer (not shown). The ROM 72 stores control programs. The CPU 71 achieves various control processes by developing the control programs stored in the ROM 72 onto the RAM 73 and executing the control programs. The RAM 73 provides a work area in executing the control programs by the CPU 71.

The various sensors 15 include a hull speed sensor, a hull acceleration sensor, a heading sensor, a distance sensor, a posture sensor, a position sensor, and a GNSS (Global Navigation Satellite System) sensor. Further, the various sensors 15 include a sensor to detect an operation of the remote control unit 12, a sensor to detect a rotational angular position of the steering 11, a sensor to detect an operation of each switch or paddle in the steering 11, and a sensor to detect an operation of the joystick 13. The hull speed sensor detects a speed (vessel speed) of the navigation of the marine vessel 1 (hull 2). The vessel speed may be obtained from a GNSS signal received by the GNSS sensor. The detection signals of the various sensors 15 are supplied to the controller 70.

The various operators 16 include setting operators to perform various settings and input operators to input various instructions in addition to operators to perform operations related to the maneuvering. Some of the various operators 16 may be arranged on the steering 11. The various operators 16 are operated by the user, and the operation signals are supplied to the controller 70. The memory 17 is preferably a readable and writable nonvolatile storage medium.

The controller 70 may exchange information with the various sensors 15 and the various operators 16 by establishing predetermined communications. The display unit 14 displays various kinds of information.

The outboard motor 4L includes an ECU (Engine Control Unit) 81, an SCU (Steering Control Unit) 82, an rpm sensor 83, an engine 84, a steering mechanism 85, various sensors 86, a steering angle sensor 87, and various actuators 88. Each of the ECU 81 and the SCU 82 includes a CPU (not shown). The ECU 81 controls the driving of the engine 84 according to an instruction from the controller 70. The SCU 82 controls the driving of the steering mechanism 85 according to an instruction from the controller 70.

The steering mechanism 85 changes the direction of the outboard motor body 20 in the left-right direction by rotating the outboard motor body 20 about the steering axis center K (FIG. 1). This changes the direction of the propulsion force acting on the stern 2A, which is the attachment position of the outboard motor body 20. The steering mechanism 85 may use an electric type or a hydraulic type. The various actuators 88 may include a power trim and tilt mechanism (PTT mechanism) that rotates the outboard motor 4L about a tilt axis.

The rpm sensor 83 detects the number of rotations per unit time period of the engine 84 (an engine rotation speed). The various sensors 86 include a throttle opening sensor. The steering angle sensor 87 detects an actual steering angle of the outboard motor 4L. The controller 70 may obtain the actual steering angle from a steering instruction value output to the steering mechanism 85.

The trolling motor 5 includes an MCU (Motor Control Unit) 57, an SCU (Steering Control Unit) 58, a steering angle sensor 55, various sensors 60, and an actuator 61 in addition to the electric motor 50 and the steering unit 56.

The MCU 57 and the SCU 58 include CPUs (not shown), respectively. The MCU 57 controls the driving of the electric motor 50 according to an instruction from the controller 70. The maximum output of the electric motor 50 may be less than the maximum output of the engine 84 of the outboard motor 4L. The SCU 58 controls the driving of the steering unit 56 according to an instruction from the controller 70 to change the direction of the propulsion force acting on the bow 2B, which is the attachment position of the trolling motor 5.

The actuator 61 moves the trolling motor 5 between the use position and the storage position. It is not essential to provide a function of moving the trolling motor 5 between the use position and the storage position by power.

The steering angle sensor 55 detects the steering angle of the trolling motor 5 changed by the steering unit 56. The detection signals by the steering angle sensor 55 and the various sensors 60 are supplied to the controller 70. It is not essential that the outboard motors 4L and 4R and the trolling motor 5 include all of the above-described sensors and actuators.

Strictly speaking, the propulsion force of each propulsion motor acts on the point at which each propulsion motor is attached to the hull 2. However, it will be assumed that the propulsion force of the trolling motor 5 acts on the bow 2B and the propulsion forces of the outboard motors 4L and 4R act on the positions of the attachment mechanisms 22 on the stern 2A for convenience of description.

Figure 6:
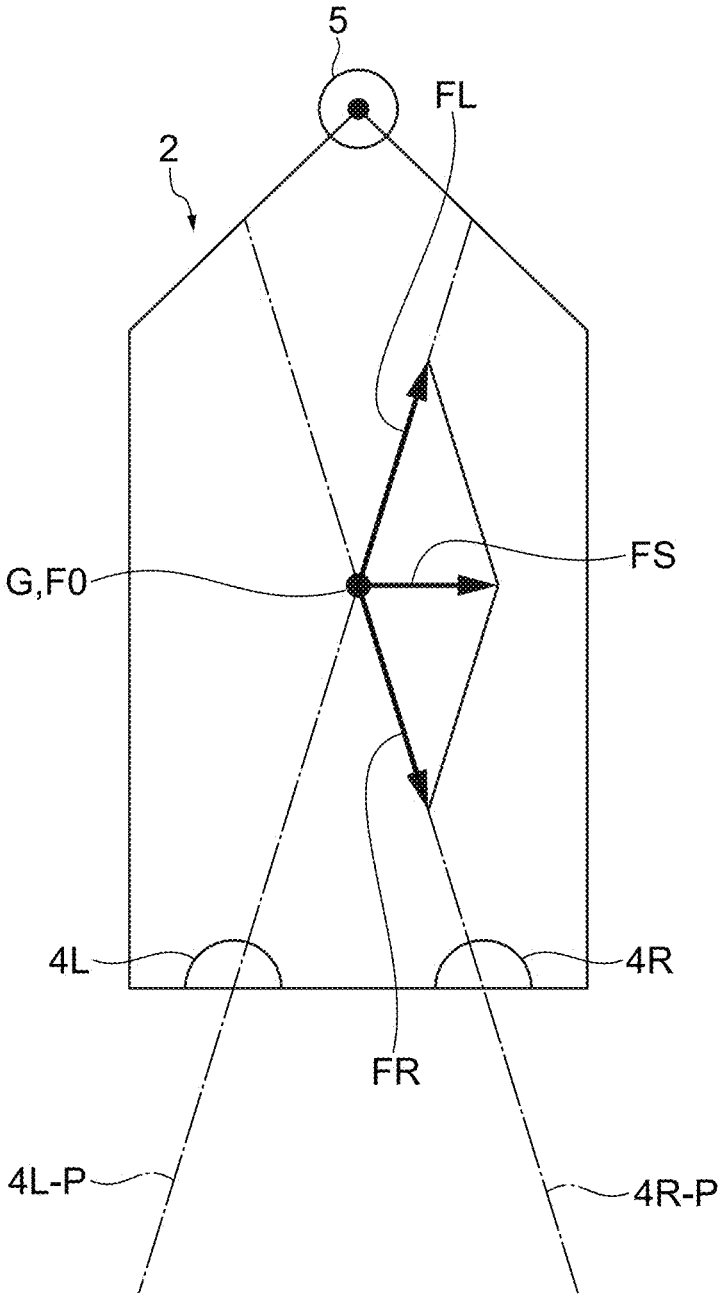
FIG. 6 is a schematic view showing propulsion forces acting on a hull in a parallel motion mode.

FIG. 6 is a schematic view showing propulsion forces acting on the hull 2 in a parallel motion mode. For convenience, the rotation center position when the hull 2 veers shall be coincident with the center of gravity G. FIG. 6 shows an example in which the hull 2 is moved laterally to the side without using the trolling motor 5. The parallel motion mode is executed, for example, when execution of a parallel motion is instructed.

As shown in FIG. 6, in the parallel motion mode in which the hull 2 is moved to the right, a first propulsion force action line 4L-P of the outboard motor 4L intersects a second propulsion force action line 4R-P of the outboard motor 4R at the center of gravity G. In this case, first propulsion force FL of the outboard motor 4L is indicated by a right frontward vector, and second propulsion force of the outboard motor 4R is indicated by a right backward vector. A resultant force of the first propulsion force FL and the second propulsion force FR is denoted by a symbol FS. The resultant force FS is indicated by a rightward vector. Therefore, the resultant force FS in the right direction as the propulsion force acts on the hull 2 at the center of gravity G as a point of action F0. Therefore, since the rotation moment does not act on the hull 2, the hull 2 moves in the right direction without veering.

In the parallel motion mode in which the hull 2 is moved to the left, the left-right direction is reversed from the example shown in FIG. 6. In this way, when the propulsion force of the trolling motor 5 is not used, the hull 2 does not veer as long as the resultant force FS of the propulsion forces of the outboard motors 4L and 4R is applied to the center of gravity G. However, in this example embodiment, the propulsion force of trolling motor 5 is also used, and further, the veering of the hull 2 and a component in an undesired direction are complemented by the trolling motor 5, and thus, a parallel motion is more efficiently achieved.

FIGS. 7A to 7H are schematic views showing the transition of the action of the propulsion force in the parallel motion mode. FIGS. 7A to 7D show the transition during the lateral motion in the right direction, and FIGS. 7E to 7H show the transition during the parallel motion in an obliquely right frontward direction. The propulsion force of the trolling motor 5 is indicated as a motor propulsion force TF. The directions and lengths of arrows indicating the resultant force FS of the propulsion forces of the outboard motors 4L and 4R and the motor propulsion force TF respectively indicate the directions and magnitudes of the propulsion forces.

First, the transition during the lateral motion in the right direction (FIGS. 7A to 7D) will be described.

When the parallel motion mode is set, the steering angles of the outboard motors 4L and 4R are controlled so that the point of action F0 of the resultant force FS is at a standby position. The standby position is coincident with the center of gravity G in this example, but may be in front of or behind the center of gravity G.

When the instruction of the parallel motion is obtained or when it is determined that the parallel motion is performed, the controller 70 obtains the direction of the parallel motion (target direction) and a required propulsion force that is required for the parallel motion of the hull 2 in the target direction from a steering instruction content. Here, the steering instruction is input by the operation of the joystick 13 in the joystick mode, and is input by the operation of at least one of the switches 63 and 64 and the paddles 67 and 68 in the steering 11 in the drive mode.

For example, in the joystick mode, the target direction is input by the tilt direction of stick 13*b*, and the required propulsion force is input by the tilt angle as an operation amount. For example, when the stick 13*b* is tilted in the right direction, the right lateral motion is instructed, and the required propulsion force is input by the tilt angle.

In the drive mode, the target direction is input by a combination of operations of the switches 63 and 64 and the paddles 67 and 68, and the required propulsion force is input by a combination of their operation amounts. For example, when only the right switch 64 is operated, the right lateral motion is instructed, and the required propulsion force corresponding to its pressing amount is input.

In the automatic maneuvering mode, the parallel motion instruction may be generated by the determination of the controller 70, and in such a case, the generated target direction and required propulsion force are treated in the same manner as the input values.

The controller 70 determines the point of action F0 based on the obtained target direction and required propulsion force during the execution of the parallel motion, and controls the outboard motors 4L and 4R so that the resultant force FS in the target direction with the required propulsion force acts on the determined point of action F0. Further, the controller 70 executes "complementary control" described below by applying the motor propulsion force TF of the trolling motor 5 in parallel with the backward movement of the point of load F0. During the execution of the parallel motion, the complementary control is applied at any time.

In the complementary control, the controller 70 controls the trolling motor 5 so that the propulsion force to cancel the veering component and the component in the direction perpendicular to the target direction (the component in the front-back direction in the lateral motion) to the hull 2 due to the resultant force FS acts on the bow 2B (the attachment position of the trolling motor 5).

Figure 7A:
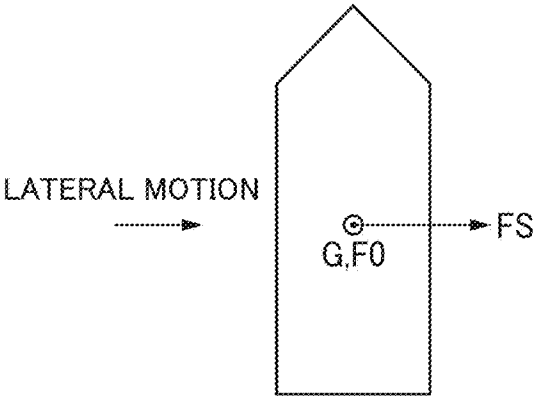
FIGS. 7A to 7H are schematic views showing transition of the action of the propulsion forces in the parallel motion mode.
Figure 7B:
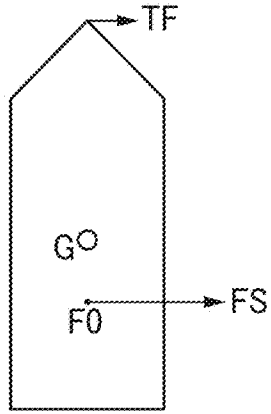

Immediately after inputting the steering instruction for the lateral motion, the resultant force FS in the right direction acts on the point of action F0 (FIG. 7A). Thereafter, the controller 70 moves the point of action F0 backward as the obtained required propulsion force increases (FIG. 7B). That is, the control is performed so that the acute angle formed by the first propulsion force action line 4L-P and the second propulsion force action line 4R-P (FIG. 6) in the back side gradually increases.

As shown in FIG. 7B, when the point of action F0 moves backward away from the center of gravity G, a left rotation moment (veering component) acts due to the resultant force FS. In order to compensate for this, the controller 70 controls the trolling motor 5 to act the motor propulsion force TF including a rightward veering component. The magnitude of the motor propulsion force TF is set so as to cancel the veering component of the resultant force FS with respect to the hull 2. Thus, the hull 2 does not veer. Since the example shown in FIG. 7B shows the lateral motion only to the side, the direction of the motor propulsion force TF may be kept to the right as long as the resultant force FS is directed to the right.

The controller 70 moves the point of action F0 until it reaches a determinable rear limit position. The rear limit position is determined by the maximum steering angles that can be taken by the respective outboard motors 4L and 4R. The information is stored in a memory or the like (not shown).

After the point of action F0 reaches the rear limit position, the controller 70 increases the propulsion forces of the outboard motors 4L and 4R as the required propulsion force increases.

Here, one of the outboard motors 4L and 4R applies the propulsion force in the forward direction, and is referred to as an "outboard motor in charge of forward motion". The other of the outboard motors 4L and 4R applies the propulsion force in the backward direction, and is referred to as an "outboard motor in charge of backward motion". Since the examples shown in FIGS. 7A to 7D shows the right lateral motion, the outboard motor 4L acts as the outboard motor in charge of forward motion and the outboard motor 4R acts as the outboard motor in charge of backward motion.

In general, the (maximum) upper limit propulsion force that is substantially generatable by the outboard motor in charge of backward motion is smaller than that of the outboard motor in charge of forward motion. This is because the engine rotational speed needs to be limited to a range in which cavitation does not occur when the propulsion force in the backward direction is applied. Therefore, when the propulsion force of the outboard motors 4L and 4R are increased, it is necessary to pay attention to the upper limit propulsion force of the outboard motor in charge of backward motion.

Figure 7C:
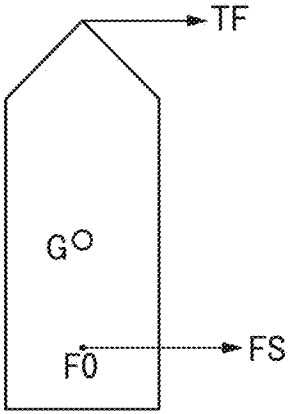

FIG. 7C shows a state in which the point of action F0 has reached the determinable rear limit position and the propulsion force of the outboard motor in charge of backward motion has reached the upper limit propulsion force.

In this example embodiment, priority is given to the movement of the point of action F0 to the rear limit position in the process in which the required propulsion force increases after the start of the parallel motion, and the propulsion forces of the outboard motors 4L and 4R are increased after the point of action F0 is positioned at the rear limit position (a first method). However, the method is not limited to the first method, and other methods, for example, the following second and third methods may be employed.

In the second method, the propulsion forces of the outboard motors 4L and 4R are increased first, and the point of action F0 is moved toward the rear limit position after the propulsion force of the outboard motor in charge of backward motion reaches the upper limit propulsion force. The point of action F0 may be moved backward while increasing the propulsion forces of the outboard motors 4L and 4R.

In the third method, the position of the point of action F0 is moved backward in accordance with a time period elapsed after the start of the parallel motion regardless of whether the required propulsion force increases. At this time, the controller 70 increases or decreases the propulsion force of each of the outboard motors 4L and 4R in consideration of the position of the point of action F0 that changes with the passage of the time period and the changing required propulsion force. In this case, the anteroposterior relationship between the timing at which the point of action F0 reaches the rear limit position and the timing at which the propulsion force of the outboard motor in charge of backward motion reaches the upper limit propulsion force is not uniformly determined.

Therefore, the controller 70 moves the position of the point of action F0 backward or increases the propulsion force of each of the outboard motors 4L and 4R according to the increase of the required propulsion force during the execution of the parallel motion. Then, even if any method is used, as the required propulsion force increases, the state shown in FIG. 7C is eventually reached. Thereafter, in order to increase the efficiency of the lateral motion, the controller 70 shifts to the control as shown in FIG. 7D as the required propulsion force increases.

In a case where the required propulsion force increases after the state shown in FIG. 7C is reached, the controller 70 increases only the propulsion force of the outboard motor in charge of forward motion. That is, the controller 70 increases the propulsion force of the propulsion device in charge of forward motion when the position of the point of action F0 reaches the rear limit position and the propulsion force of the propulsion device in charge of backward motion reaches the upper limit propulsion force during the execution of the parallel motion.

Figure 7D:
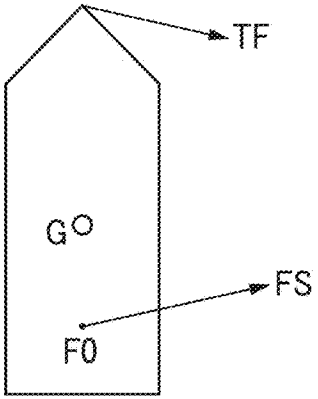

When the propulsion force of the propulsion device in charge of forward motion is increased while the point of action F0 is maintained at the rear limit position and the propulsion force of the propulsion device in charge of backward motion is maintained at the upper limit propulsion force, the forward component occurs in the resultant force FS (FIG. 7D). That is, the direction of the resultant force FS becomes an obliquely right forward direction. If this state is maintained, the hull 2 moves forward and veers in the left rotation direction. Therefore, the controller 70 controls the motor propulsion force TF of the trolling motor 5 so as to cancel these by the complementary control.

For example, as shown in FIG. 7D, the direction and magnitude of the motor propulsion force TF are controlled to cancel the forward component of the resultant force FS and the veering component of the resultant force FS. As a result, the rightward propulsion force acting on the hull 2 further increases from the state shown in FIG. 7C. Therefore, the hull 2 is moved to the right at a speed corresponding to the increase of the required propulsion force without moving in the front-back direction and without veering.

Similarly, in the parallel motion in which the target direction is the obliquely right forward direction (FIGS. 7E to 7H), the controller 70 applies the resultant force FS in the target direction corresponding to the required propulsion force to the point of action F0 determined based on the target direction and required propulsion force, and in parallel therewith, executes the complementary control by the trolling motor 5.

Figure 7E:
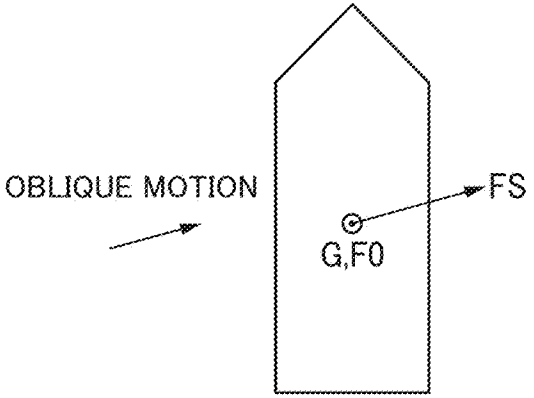
Figure 7F:
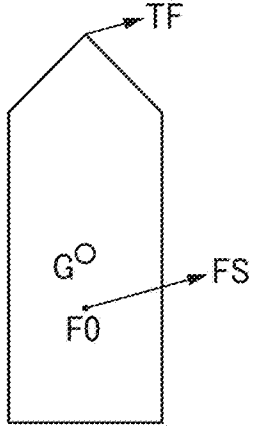
Figure 7G:
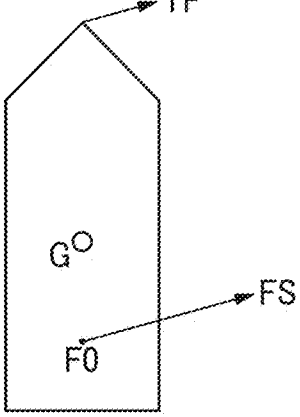

During the parallel motion in the obliquely right forward direction, the directions of the resultant force FS and the motor propulsion force TF are the obliquely right forward direction until the point of action F0 reaches the rear limit position and the propulsion force of the outboard motor in charge of backward motion reaches the upper limit propulsion force (a state shown in FIG. 7E shifts to a state shown in FIG. 7G). Their magnitudes vary at any time.

Figure 7H:
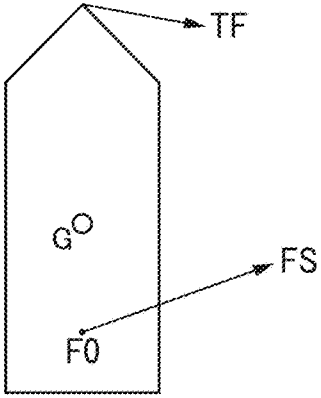

Then, after the state shown in FIG. 7G is reached, the controller 70 increases the propulsion force of the propulsion device in charge of forward motion while maintaining the point of action F0 at the rear limit position and maintaining the propulsion force of the propulsion device in charge of backward motion at the upper limit propulsion force. In this case, the forward component of the resultant force FS becomes larger (FIG. 7H). Therefore, the controller 70 controls the trolling motor 5 to apply the motor propulsion force TF having the magnitude that cancels the component of the resultant force FS in the direction perpendicular to the target direction and the veering component of the resultant force FS.

As a result, the propulsion force in the target direction acting on the hull 2 further increases from the state shown in FIG. 7G. Therefore, the hull 2 moves in the target direction at a speed corresponding to the increase in the required propulsion force, without moving in the direction perpendicular to the target direction and without veering.

Figure 8:
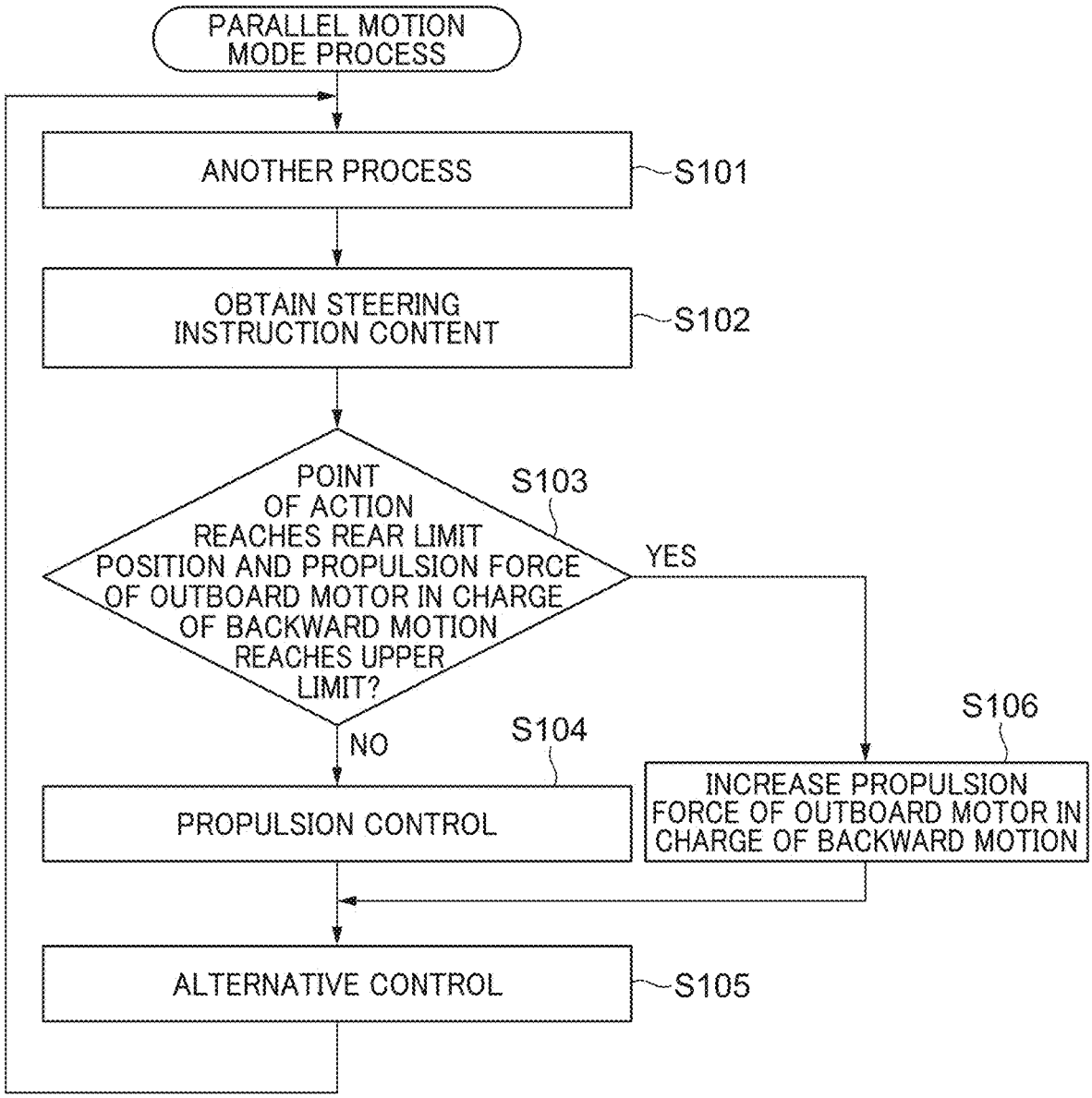
FIG. 8 is a flowchart showing a parallel motion mode process.

FIG. 8 is a flowchart showing a parallel motion mode process. This process is achieved by the CPU 71 developing a program stored in the ROM 72 onto the RAM 73 and executing the program. This process is started, for example, when the start of the parallel motion mode is instructed. When the instruction of the parallel motion is obtained or when it is determined that the parallel motion is performed, the start of the parallel motion mode is instructed. The instruction of the parallel motion is input by, for example, a setting operator or an input operator in the various operators 16. The case where it is determined that the parallel motion is performed includes a case where the controller 70 determines that the operation of the parallel motion is necessary during the automatic maneuvering mode.

When the parallel motion mode process is started, the controller 70 controls the steering angles of the outboard motors 4L and 4R so that the point of action F0 of the resultant force FS is at the standby position.

In a step S101, the controller 70 executes another process. Here, for example, when an instruction to end the parallel motion mode is received, a process to end this process is executed.

In a step S102, the controller 70 obtains the steering instruction content from the operation of the stick 13*b* of the joystick 13 or the operation of the switches 63 and 64, the paddles 67 and 68, and the like in the steering 11 corresponding to the maneuvering mode. As described above, the steering instruction content includes the target direction and the required propulsion force.

In a step S103, the controller 70 determines whether the point of action F0 reaches the rear limit position and the propulsion force of the propulsion device in charge of backward motion reaches the upper limit propulsion force. Whether the propulsion force of the propulsion device in charge of backward motion reaches the upper limit propulsion force may be determined from the engine rotational speed, for example. Alternatively, it may be determined that the upper limit propulsion force has been reached when a command value to the engine 84 exceeds a predetermined value. Then, the controller 70 proceeds with the process to a step S104 when the point of action F0 does not reach the rear limit position or the propulsion force of the propulsion device in charge of backward motion does not reach the upper limit propulsion force.

In the step S104, the controller 70 executes aa propulsion control according to the first method. That is, as described above, the controller 70 moves the point of action F0 until reaching the rear limit position and then increases the propulsion forces of the outboard motors 4L and 4R according to the increase in the required propulsion force. Alternatively, the controller 70 controls the outboard motors 4L and 4R by the second method or the third method. Further, in parallel with the first, second, or third method, the controller 70 executes the complementary control by the trolling motor 5.

In a step S105, the controller 70 executes an alternative control. Here, for example, when the veering instruction or a situation requiring veering is provided, a control process corresponding thereto is executed. This control process will be described below with reference to FIGS. 9A to 11C. After the step S105, the controller 70 returns the process to the step S101.

As a result of the determination in the step S103, when the point of action F0 reaches the rear limit position and the propulsion force of the propulsion device in charge of backward motion reaches the upper limit propulsion force, the controller 70 executes a step S106.

In the step S106, the controller 70 increases the propulsion force of the outboard motor in charge of forward motion according to the increase in the required propulsion force. In parallel with this, the complementary control by the trolling motor 5 is also executed. This enables the parallel motion efficiently without veering the hull 2. After the step S106, the controller 70 proceeds with the process to the step S105.

Although not shown, the marine vessel 1 includes functional blocks to achieve the parallel motion mode process (FIG. 8). The functional blocks include functional units, such as an obtaining unit and a control unit. The functions of these functional units are achieved mainly by cooperation of the CPU 71, ROM 72, RAM 73, sensor 15, 55, 60, 83, 86, 87, and the like.

Examples of the alternative control executed in the step S105 will be described with reference to FIGS. 9A to 11C. The alternative control shall be executed when the veering instruction is input by the twisting operation of the stick 13*b* or the rotational operation of the wheel 43 or when the controller 70 determines that the veering is necessary in the automatic maneuvering mode.

In FIGS. 9A to 11C, transitions in a case where the twisting operation of the stick 13*b* is performed in the parallel motion mode in the joystick mode are illustrated. In each drawing, regarding the motor propulsion force TF and the resultant force FS, a thin line arrow indicates a propulsion force before the twisting operation of the stick 13*b* and a thick line arrow indicates a propulsion force after the twisting operation of the stick 13*b*. In addition, in FIGS. 9A to 11C, for convenience of description, it is assumed that the target direction and required propulsion force do not change.

Figure 9A:
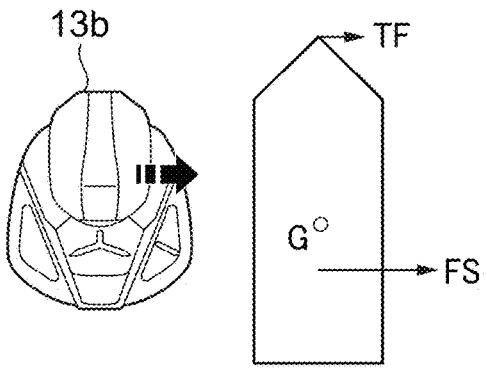
FIGS. 9A and 9B are transition diagrams in a case where a joystick is twisted in the parallel motion mode.
Figure 9B:
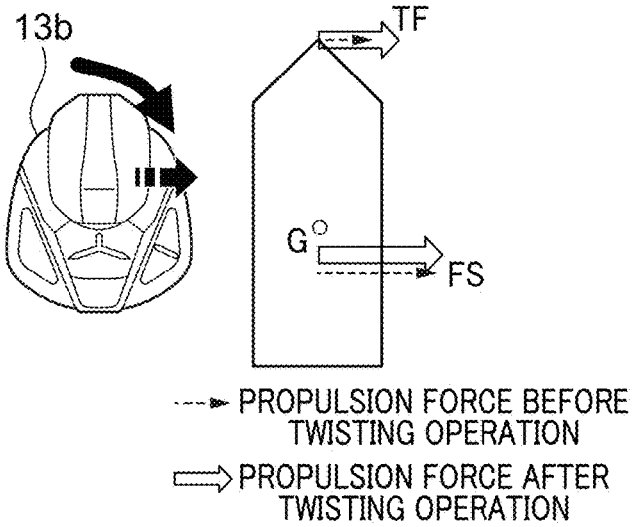

FIGS. 9A and 9B are transition diagrams at the stage where the point of action F0 does not reach the rear limit position or the propulsion force of the propulsion device in charge of backward motion does not reach the upper limit propulsion force (by the process in S105 in the loop of S103, S104, and S105).

The state shown in FIG. 9A is the same as the state shown in FIG. 7B, and in this state, the stick 13*b* is not operated by twisting. FIG. 9B is a state diagram in a case where the stick 13*b* is operated by twisting in the right rotation direction.

When the stick 13*b* is operated by twisting in the right rotation direction from the state shown in FIG. 9A, the controller 70 moves the point of action F0 closer to the center of gravity G and increases the motor propulsion force TF (FIG. 9B). By bringing the point of action F0 closer to the center of gravity G, the leftward veering component due to the resultant force FS is reduced. The right veering component increases by increasing the motor propulsion force TF. Thus, the combination of the resultant force FS and the motor propulsion force TF generates a right veering component, and therefore, the hull 2 laterally moves rightward while veering in the right rotation direction.

In this way, the outboard motors 4L, 4R, and the trolling motor 5 are controlled so as to add the necessary veering component while maintaining the parallel motion in the target direction.

When the target direction is the left direction and the stick 13*b* is operated by twisting in the left rotation direction, the left and right directions are reversed with respect to FIGS. 9A and 9B.

FIGS. 10A, 10B, and 10C, and FIGS. 11A, 11B, and 11C are transition diagrams showing the states after the point of action F0 reaches the rear limit position and the propulsion force of the propulsion device in charge of backward motion reaches the upper limit propulsion force (by the process in S105 in the loop of S103, S106, and S105).

Figure 10A:
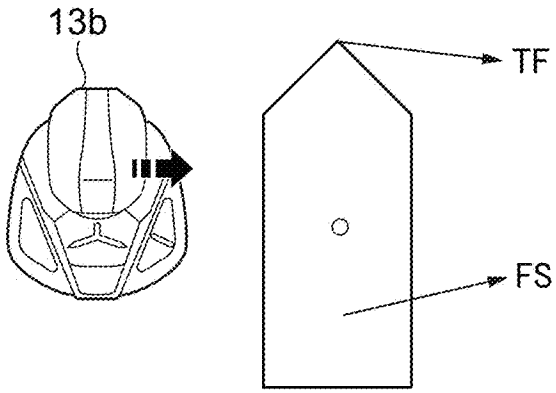
FIGS. 10A to 10C are transition diagrams in the case where the joystick is twisted in the parallel motion mode.
Figure 11A:
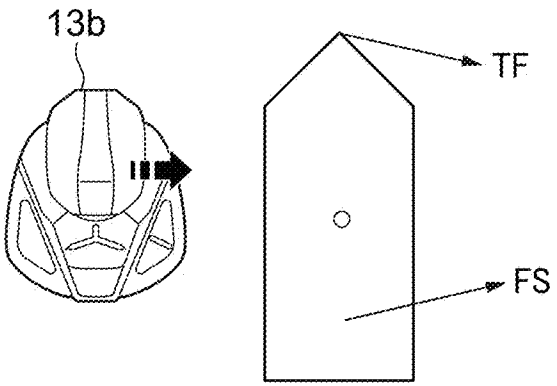
FIGS. 11A to 11C are transition diagrams in the case where the joystick is twisted in the parallel motion mode.

The states shown in FIGS. 10A and 11A are the same as the state shown in FIG. 7D, and in this state, the stick 13*b* is not operated by twisting.

Figure 10B:
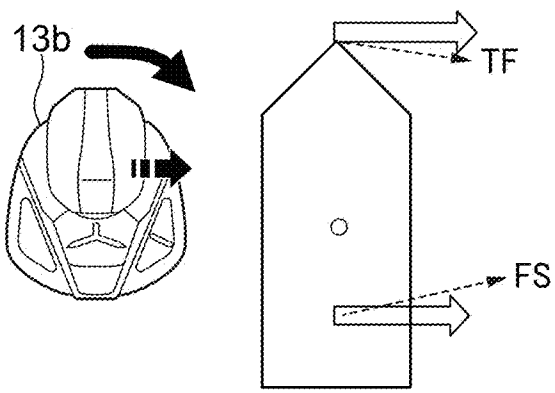

When the stick 13*b* is operated by twisting in the right rotation direction from the state shown in FIG. 10A, the controller 70 changes the direction of the motor propulsion force TF to a direction in which the right veering component increases as shown in FIG. 10B. Since the component in the front-back direction is generated by the change in the direction of the motor propulsion force TF, the controller 70 changes the direction of the resultant force FS so as to cancel the component in the front-back direction (decreases the propulsion force of the outboard motor in charge of forward motion). Thus, the combination of the resultant force FS and the motor propulsion force TF generates the right veering component, and therefore, the hull 2 laterally moves rightward while veering in the right rotation direction.

Figure 10C:
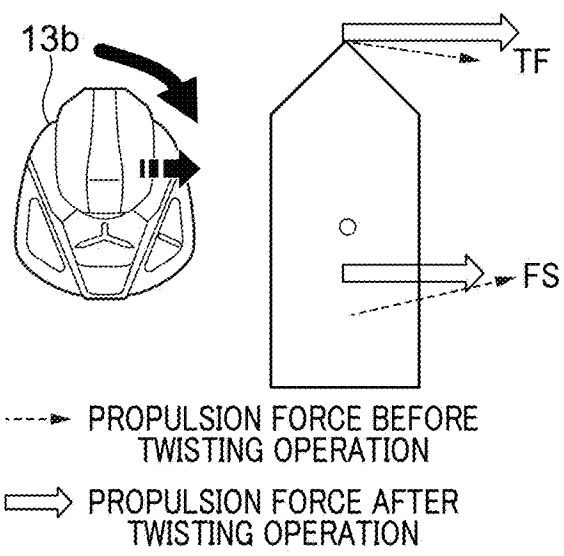

When the stick 13*b* is further operated by twisting in the right rotation direction from the state shown in FIG. 10B, the controller 70 increases the right veering component by increasing the motor propulsion force TF as shown in FIG. 10C. In parallel with this, the controller 70 brings the point of action F0 closer to the center of gravity G, thus reducing the left veering component. Since the combination of the resultant force FS and the motor propulsion force TF increases the right veering component, the hull 2 laterally moves rightward while veering in the right rotation direction.

In this way, when the veering direction corresponding to the veering instruction is coincident with the direction of the component of the target direction in the lateral direction, the trolling motor 5 is controlled so as to bring the point of action F0 closer to the center of gravity G and add the necessary veering component while maintaining the parallel motion in the target direction.

When the target direction is the left direction and the stick 13*b* is operated by twisting in the left rotation direction, the left and right directions are reversed with respect to FIGS. 10A to 10C.

Figure 11B:
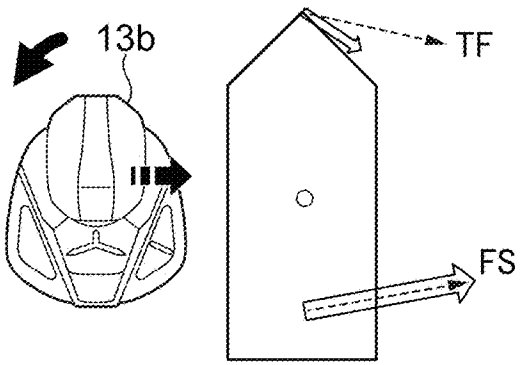

When the stick 13*b* is operated by twisting in the left rotation direction from the state shown in FIG. 11A, the controller 70 changes the direction of the motor propulsion force TF to a direction in which the left veering component increases (the direction in which the right veering component is decreased) as shown in FIG. 11B. At this time, the direction and magnitude of the motor propulsion force TF are controlled so that the component in the front-back direction by the motor propulsion force TF will not change. The resultant force FS does not change.

Figure 11C:
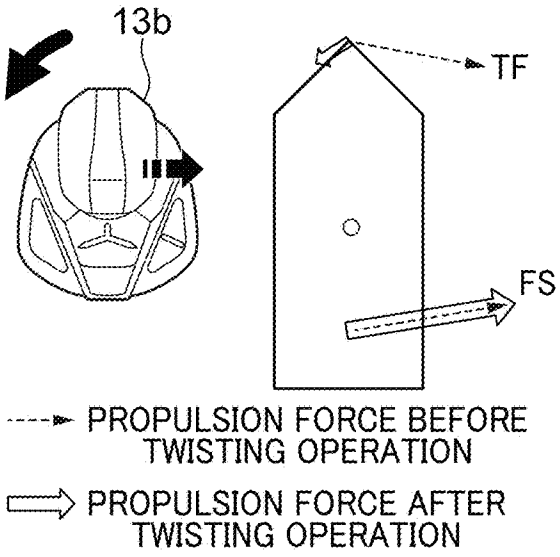

When the stick 13*b* is further operated by twisting in the left rotation direction from the state shown in FIG. 11B, the controller 70 changes the direction of the motor propulsion force TF to a direction in which the left veering component increases (the direction in which the right veering component is decreased) as shown in FIG. 11C. At this time, the direction and magnitude of the motor propulsion force TF are controlled so that the component in the front-back direction by the motor propulsion force TF will not change. In the example shown in FIG. 11C, the motor propulsion force TF has a left component in the lateral direction. The resultant force FS does not change. Therefore, the hull 2 laterally moves rightward while veering in the left rotation direction.

In this way, when the veering direction corresponding to the veering instruction is opposite to the direction of the component of the target direction in the lateral direction, the resultant force FS to the point of action F0 is maintained as-is, and the trolling motor 5 is controlled so as to add the necessary veering component while maintaining the parallel motion in the target direction.

When the target direction is the left direction and the stick 13*b* is operated by twisting in the left rotation direction, the left and right directions are reversed with respect to FIGS. 11A to 11C.

Even in the case where the wheel 43 is operated by rotating in the parallel motion mode in the drive mode, the alternative control (the step S105) is applied as with the case of the twisting operation of the stick 13*b*.

According to this example embodiment, the controller 70 controls the outboard motors 4L and 4R so that the resultant force FS will act on the point of action F0 determined based on the target direction and the required propulsion force and controls the trolling motor 5 so as to apply the motor propulsion force TF that cancels the veering component and the component in the direction perpendicular to the target direction due to the resultant force FS, during the execution of the parallel motion.

The controller 70 moves the position of the point of action F0 backward or increases the resultant force FS as the required propulsion force increases during the execution of the parallel motion, and increases the propulsion force of the propulsion device in charge of forward motion after the point of action F0 reaches the rear limit position and the propulsion force of the propulsion device in charge of reverse motion reaches the upper limit propulsion force. By using the trolling motor 5 in combination, the parallel motion component can be increased while reducing or preventing the component in the undesired direction. Thus, the performance of the parallel motion is improved.

In addition, when the veering instruction is obtained or it is determined to execute the veering during the execution of the parallel motion, the outboard motors 4L and 4R, and the trolling motor 5 are controlled so as to add the necessary veering component while maintaining the parallel motion in the target direction (FIGS. 9A to 11C). This enables the veering while maintaining the efficient parallel motion.

Three or more propulsion devices applying the resultant force FS may be arranged at the stern 2B. Note that, when three or more propulsion devices are arranged, two or more outboard motors may be in charge of backward motion.

In application of preferred embodiments of the present invention, the propulsion device disposed at a predetermined position in front of the stern 2A is not limited to an electric propulsion device like the trolling motor 5, and may be an engine propulsion device including an outboard motor. Further, the propulsion devices disposed in the stern 2A are not limited to the outboard motors 4L and 4R, and may be inboard motors, inboard/outboard motors, and a jet boat motor. Further, the propulsion device is not limited to an engine propulsion device and may be an electric propulsion device.

The example embodiments of the present invention can also be achieved by a process in which a program for providing one or more functions of the above-described example embodiments is supplied to a system or an apparatus via a network or a non-transitory storage medium, and one or more processors of a computer of the system or the apparatus read and execute the program. The program and the storage medium storing the program may correspond to an example embodiment of the present invention. The present invention can also be implemented by a circuit (for example, an ASIC) that implements one or more functions.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

first propulsion devices that are steerable and located at a stern of a hull;

a second propulsion device that is steerable and located at a predetermined position in front of the stern of the hull; and a controller configured or programmed to:

obtain a target direction and a required propulsion force when an instruction of a parallel motion is obtained or when it is determined to execute the parallel motion;

determine a point of action of a resultant force of propulsion forces applied to the hull by the first propulsion devices to execute the parallel motion based on the target direction and the required propulsion force; and during execution of the parallel motion, the controller is configured or programmed to:

control the first propulsion devices to apply the resultant force corresponding to the required propulsion force in the target direction to the point of action, and control the second propulsion device to apply a propulsion force to the predetermined position to cancel a veering component and a component in a direction perpendicular to the target direction acting on the hull due to the resultant force;

move a position of the point of action backward or increase the propulsion forces of the first propulsion devices as the required propulsion force increases; and increase the propulsion force of at least one of the first propulsion devices applying the propulsion force including a component in a forward direction as the required propulsion force increases when the position of the point of action reaches a rear limit position and the propulsion force of at least one of the first propulsion devices applying the propulsion force including a component in a backward direction reaches an upper limit propulsion force generatable.

2. The marine propulsion system according to claim 1, wherein the controller is configured or programmed to move the position of the point of action backward as the required propulsion force increases during the execution of the parallel motion and increases the propulsion forces of the first propulsion devices after the position of the point of action reaches the rear limit position.

3. The marine propulsion system according to claim 1, wherein the controller is configured or programmed to increase the propulsion forces of the first propulsion devices as the required propulsion force increases during the execution of the parallel motion, and then move the position of the point of action backward after the propulsion force of at least one of the first propulsion devices applying the propulsion force including the component in the backward direction reaches the upper limit propulsion force.

4. The marine propulsion system according to claim 1, wherein the controller is configured or programmed to move the position of the point of action backward after a time period from a start of the parallel motion has elapsed.

5. The marine propulsion system according to claim 1, wherein the controller is configured or programmed to control the first propulsion devices and the second propulsion device to add a veering component while maintaining the parallel motion in the target direction, when a veering instruction is obtained or when it is determined that the veering is performed during the execution of the parallel motion.

6. The marine propulsion system according to claim 5, wherein the controller is configured or programmed to control the second propulsion device to bring the point of action closer to a veering center of the hull and to add a turning component while maintaining the parallel motion in the target direction, when the target direction and the required propulsion force do not change and a veering direction corresponding to the veering instruction is coincident with the direction of the component of the target direction in a lateral direction.

7. The marine propulsion system according to claim 5, wherein the controller is configured or programmed to control the second propulsion device to add a veering component while maintaining the resultant force with respect to the point of action and maintaining the parallel motion in the target direction, when the target direction and the required propulsion force do not change and a veering direction corresponding to the veering instruction is opposite to the direction of the component of the target direction in a lateral direction.

8. The marine propulsion system according to claim 1, wherein the predetermined position is located on a bow of a marine vessel.

9. The marine propulsion system according to claim 1, wherein the second propulsion device includes a trolling motor.

10. A marine vessel comprising:

a hull; and a marine propulsion system comprising:

first propulsion devices that are steerable and located at a stern of a hull;

a second propulsion device that is steerable and located at a predetermined position in front of the stern of the hull; and a controller configured or programmed to:

obtain a target direction and a required propulsion force when an instruction of a parallel motion is obtained or when it is determined to execute the parallel motion;

determine a point of action of a resultant force of propulsion forces applied to the hull by the first propulsion devices to execute the parallel motion based on the target direction and the required propulsion force,; and during execution of the parallel motion, the controller is configured or programmed to:

control the first propulsion devices to apply the resultant force corresponding to the required propulsion force in the target direction to the point of action determined, and control the second propulsion device to apply a propulsion force to the predetermined position to cancel a veering component and a component in a direction perpendicular to the target direction acting on the hull due to the resultant force;

move a position of the point of action backward or increase the propulsion forces of the first propulsion devices as the required propulsion force increases; and increase the propulsion force of at least one of the first propulsion devices applying the propulsion force including a component in a forward direction as the required propulsion force increases when the position of the point of action reaches a rear limit position and the propulsion force of at least one of the first propulsion devices applying the propulsion force including a component in a backward direction reaches an upper limit propulsion force generatable.

11. A control method for a marine propulsion system including first propulsion devices that are steerable and located at a stern of a hull and a second propulsion device that is steerable and located at a predetermined position in front of the stern of the hull, the control method comprising:

obtaining a target direction and a required propulsion force when an instruction of a parallel motion is obtained or when it is determined to execute the parallel motion;

determining a point of action of a resultant force of propulsion forces applied to the hull by the first propulsion devices during execution of the parallel motion based on the target direction and the required propulsion force obtained; and during execution of the parallel motion:

controlling the first propulsion devices to apply the resultant force corresponding to the required propulsion force in the target direction to the point of action;

controlling the second propulsion device to apply a propulsion force to the predetermined position to cancel a veering component and a component in a direction perpendicular to the target direction acting on the hull due to the resultant force;

moving a position of the point of action backward or increasing the propulsion forces of the first propulsion devices as the required propulsion force increases; and increasing the propulsion force of at least one of the first propulsion devices applying the propulsion force including a component in a forward direction as the required propulsion force increases when the position of the point of action reaches a rear limit position and the propulsion force of at least one of the first propulsion devices applying the propulsion force including a component in a backward direction reaches an upper limit propulsion force generatable.

* * * * *